US008950445B2

(12) United States Patent
Schlipf et al.

(10) Patent No.: US 8,950,445 B2
(45) Date of Patent: Feb. 10, 2015

(54) DEVICE FOR FILLING AT LEAST ONE DOSING CHAMBER

(75) Inventors: Jens Schlipf, Freiberg A.N. (DE); Ralf Schmied, Freiberg (DE); Werner Runft, Winnenden (DE); Thomas Franck, Lorch-weitmars (DE)

(73) Assignee: Robert Bosch GmbH, Stuttgart (DE)

( * ) Notice: Subject to any disclaimer, the term of this patent is extended or adjusted under 35 U.S.C. 154(b) by 1416 days.

(21) Appl. No.: 12/294,134

(22) PCT Filed: Feb. 20, 2007

(86) PCT No.: PCT/EP2007/051605

§ 371 (c)(1),
(2), (4) Date: Sep. 23, 2008

(87) PCT Pub. No.: WO2007/113048

PCT Pub. Date: Oct. 11, 2007

(65) Prior Publication Data

US 2009/0232922 A1 Sep. 17, 2009

(30) Foreign Application Priority Data

Mar. 29, 2006 (DE) ..... 10 2006 014 496

(51) Int. Cl.
*B65B 1/20* (2006.01)
*B65B 43/42* (2006.01)
*A61J 3/07* (2006.01)

(52) U.S. Cl.
CPC ..... *A61J 3/074* (2013.01)
USPC ..... 141/71; 141/81; 141/146

(58) Field of Classification Search
CPC ..... A61J 3/074
USPC ..... 141/71, 81, 146, 238; 425/150; 222/168.5; 53/475, 503, 250–253
See application file for complete search history.

(56) References Cited

U.S. PATENT DOCUMENTS

| | | | | |
|---|---|---|---|---|
| 1,876,813 | A | 9/1932 | Wilkie et al. | |
| 1,986,813 | A * | 1/1935 | Harrison | 57/77 |
| 3,213,587 | A | 10/1965 | Carruthers | |
| 4,750,313 | A * | 6/1988 | Kammler et al. | 53/451 |
| 5,117,612 | A * | 6/1992 | Keim et al. | 53/451 |
| 5,377,474 | A * | 1/1995 | Kovacs et al. | 53/64 |
| 5,551,206 | A | 9/1996 | Fukuda | |
| 5,855,233 | A | 1/1999 | Bolelli | |
| 7,677,016 | B2 * | 3/2010 | Trebbi | 53/560 |
| 2001/0035431 | A1 | 11/2001 | Runft | |

FOREIGN PATENT DOCUMENTS

| | | | |
|---|---|---|---|
| DE | 3907208 | A1 | 4/1990 |
| DE | 10001068 | C1 | 5/2001 |
| EP | 0838209 | A1 | 4/1998 |

* cited by examiner

*Primary Examiner* — Jason Boeckmann
*Assistant Examiner* — Steven M Cernoch
(74) *Attorney, Agent, or Firm* — Michael Best Friedrich LLP

(57) ABSTRACT

A device for filling at least one dosing chamber is provided, with at least one dosing chamber arranged in a dosing disc into which a filling material is to be introduced. At least one ram acts on the material located in the dosing chamber. The at least one ram is arranged on a support, and at least two columns are connected to the support. A drive mechanism is provided which, via a coupling mechanism, moves at least the two columns up and down in synch.

17 Claims, 4 Drawing Sheets

42
29
34
35
10
32
36
28
31
30
13
27
27
11
33
12
1
2
22
22
14
2
3
15
17
17
21
3
20
21
26
26
24
23
25

DEVICE FOR FILLING AT LEAST ONE DOSING CHAMBER

CROSS-REFERENCE TO RELATED APPLICATION

This application is a 35 USC 371 application of PCT/EP 2007/051605 filed on Feb. 20, 2007.

BACKGROUND OF THE INVENTION

1. Field of the Invention

The invention is based on a device for filling at least one dosing chamber.

2. Description of the Prior Art

From German Patent DE 100 01 068 C1, a device of this kind for dosing and feeding powder into hard gelatin capsules or the like is already known. This device has an incrementally rotated dosing disk, in the bottom of which bores are embodied that cooperate with stuffing rams that are movable up and down. The stuffing rams are disposed on a common stuffing ram support, and on plunging into the bores they compact the powder into compacts. The support is moved up and down by means of columns. However, only limited stuffing forces can be generated. Moreover, the length of the stuffing stroke can be varied only by changing the mechanics. Furthermore, it is problematic that with as a rule a separate drive of the columns, the stuffing device twists, which unnecessarily produces friction and wear.

OBJECT AND SUMMARY OF THE INVENTION

It is the object of the invention to eliminate or at least lessen the aforementioned difficulties.

The device according to the invention for filling at least one dosing chamber has the advantage over the prior art that because of the synchronous motion of the at least two columns, twisting of the arrangement that carries the rams is avoided. As a result, the wear caused by friction can be minimized as well. In addition, only a single drive has to be provided for the entire arrangement, and as a result the complexity of the system is reduced, and easy regulation is attained.

In an expedient refinement, it is provided that the drive mechanism centrally predetermines a motion profile of the columns. As a result, merely by a different triggering of the drive mechanism, the motion profile of the columns can also be varied synchronously, such as the length of the stroke, the stroke speed, or the stroke acceleration.

In an expedient refinement, it is provided that the columns of the support are moved via at least two gear mechanisms, preferably crank mechanisms, that are connected to one another by the coupling mechanism. The rotational motion of the one drive is converted, via the crank mechanism, into a synchronous linear motion for the at least two columns. An electric motor, which is distinguished by ease of regulation, is preferably suitable as the drive mechanism.

The drive is now triggered according to the invention such that the crank mechanism does not execute a complete revolution but instead is merely moved up and down by means of a purposeful reciprocating motion of the drive. The angle by which the crank mechanism is moved from the left reversal position to the right reversal position and vice versa defines the length of the stroke of the support and hence of the ram. By varying the this angle or the location of the reversal points that define this angle, the stroke of the ram can be varied in a very simple way, without requiring a complicated adjustment of the mechanics. In particular, in the variation of the maximum possible stroke, the ram can be moved into a maintenance position in which the dosing disk can easily be cleaned, for instance, without colliding with the rams. Moreover, by means of a skilled selection of the speed and/or acceleration of the drive in the vicinity of the reversal points, the arrangement allows a targeted variation of the stuffing forces. In electric drives, accelerations can easily be defined and modified as a function of position in the controller. With high acceleration, high stuffing forces, and correspondingly with low acceleration, lesser stuffing forces, are attainable.

In an expedient refinement, it is provided that for each column, its own crank mechanism is provided. To improve the stability of the dosing device, at least three columns are as a rule suitable, all of which are moved up and down synchronously with the same stroke or motion profile by means of only one drive. These crank mechanisms are connected to one another or only to the drive by coupling mechanisms, so that the motion profile predetermined by the drive is available in the same way for the other crank mechanisms as well. The synchronicity of the motion of the columns can thus be assured.

In an expedient refinement, it is provided that coupling rods, belts, gear wheels, or chains are used as the coupling mechanism.

BRIEF DESCRIPTION OF THE DRAWINGS

One exemplary embodiment of the device according to the invention for filling at least one dosing chamber will be described in further detail below with reference to the drawings, in which.

DESCRIPTION OF THE PREFERRED EMBODIMENTS

Figure 1:
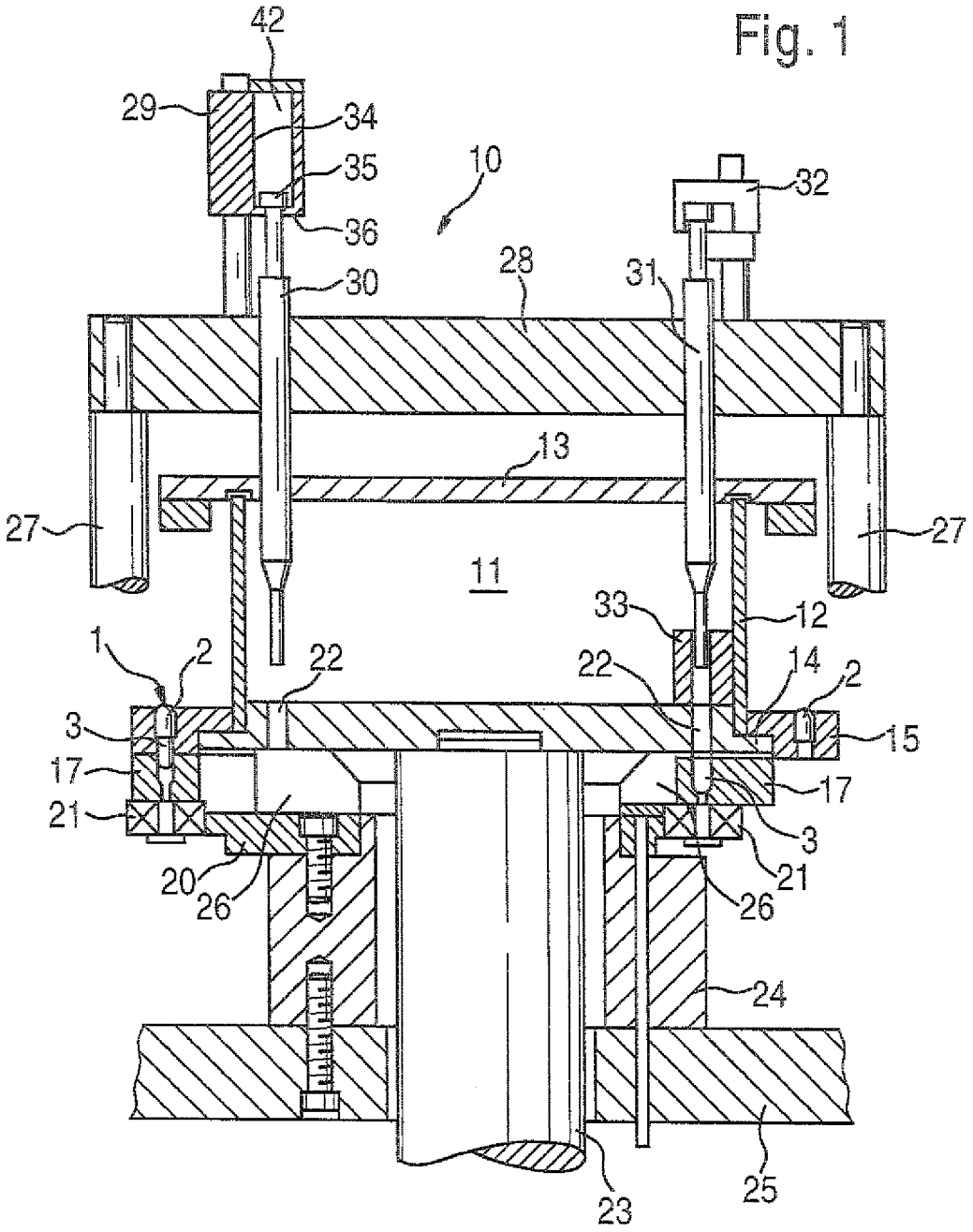
FIG. 1 is a longitudinal section through a device for filling at least one dosing chamber.

The device shown in FIG. 1 for filling at least one dosing chamber and then dispensing powder into hard gelatin capsules 1 or the like has a container 11 for material to be dispensed. The container 11 for material to be dispensed is formed by a casing 12, a cap 13, and a dosing disk 14. At the level of the dosing disk 14, the container 11 for material to be dispensed is enclosed by a ring 15 that serves to receive upper capsule parts 2. Below the ring 15, segments 17 are provided, which are correspondingly embodied for receiving lower capsule parts 3. The segments 17 are each pivotably supported by a respective bolt, not shown, that is secured in the ring 15. The segments 17 are attached to a cam roller 21 in a manner such that the segments 17 are moved upon revolution of the dosing disk by engagement of the cam roller 21 with a fixed cam 20 moving cam roller 21 inward, to suit the requirements, or in other words beneath bores or dosing chambers 22 of the dosing disk 14, or outward, that is, past the circumference of the ring 15. The dosing disk 14 is secured to a shaft 23, which is coupled with a drive, not shown in further detail, of the device 10 and which rotates the dosing disk 14 incrementally onward by one angular amount at a time. For securing the cam 20, a second ring 24 is provided, which in turn is secured to the tabletop 25 of the device 10. Between the cam 20 and the dosing disk 14, an intermediate ring 26 is provided, which in a manner known per se can be pressed against the underside of the dosing disk 14 by adjusting means, not shown. This intermediate ring 26 serves to seal off the dosing chambers 22 of the dosing disk 14 in the region where the powder is metered. Above the container 11 for material to be dispensed is a support 28, which is movable up and down by means of columns 27 and executes a defined stroke accordingly. Along a pitch circle of the support 28, a plurality of stuffing ram supports 29 are disposed at equal angular intervals, and stuffing rams 30, for instance five of them, are guided in them and penetrate the cap 13 of the container 11 for material to be dispensed in corresponding bores. Expulsion rams 31 are also disposed on the support 28, which are connected in a manner adjustable in height to a mount 32 disposed on the support 28. Inside the container 11 for material to be dispensed, the expulsion rams 31 are surrounded by a powder rejection body 33.

Figure 2:
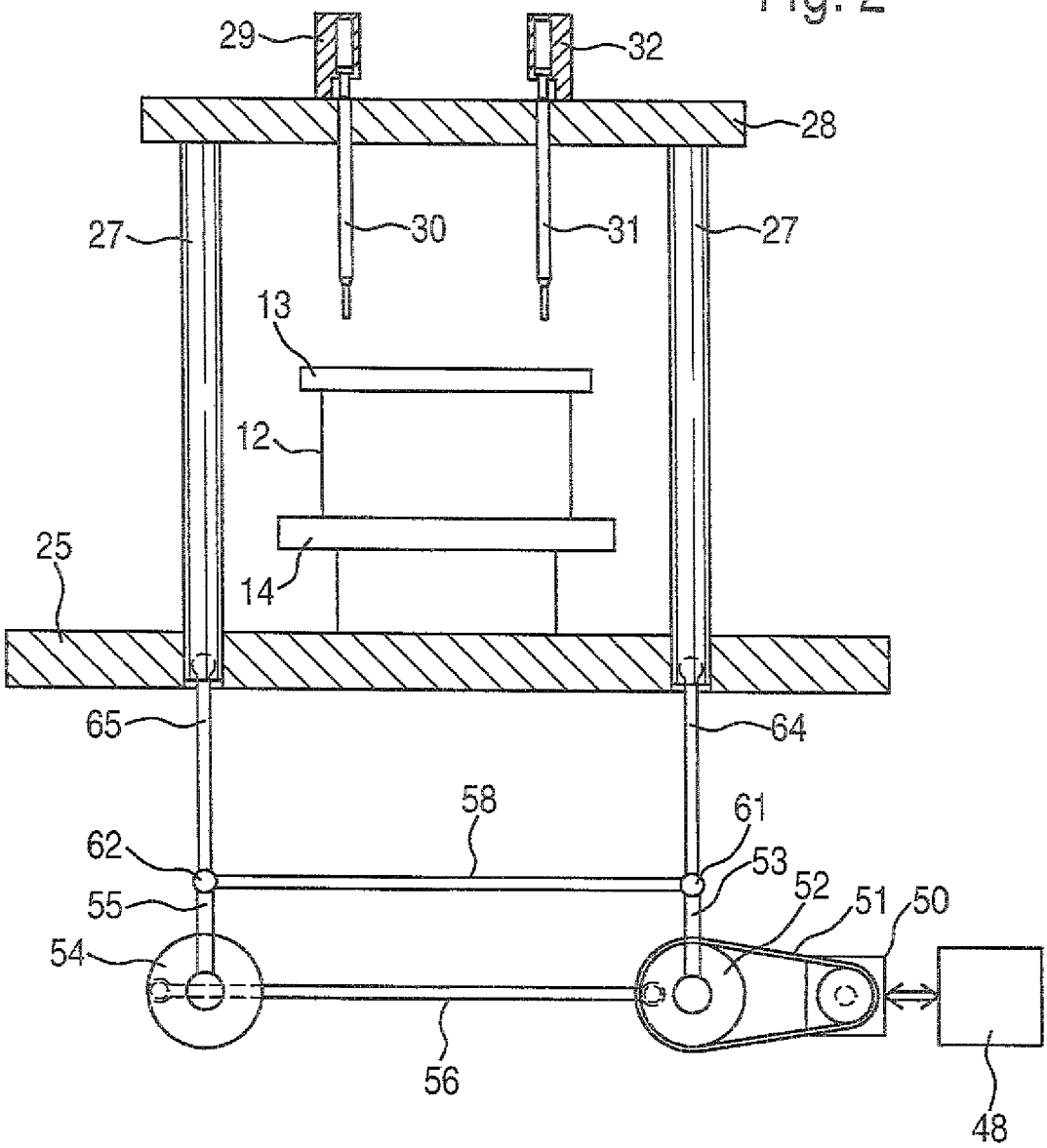
FIG. 2 is a schematic view of the device in the maintenance position.
Figure 3:
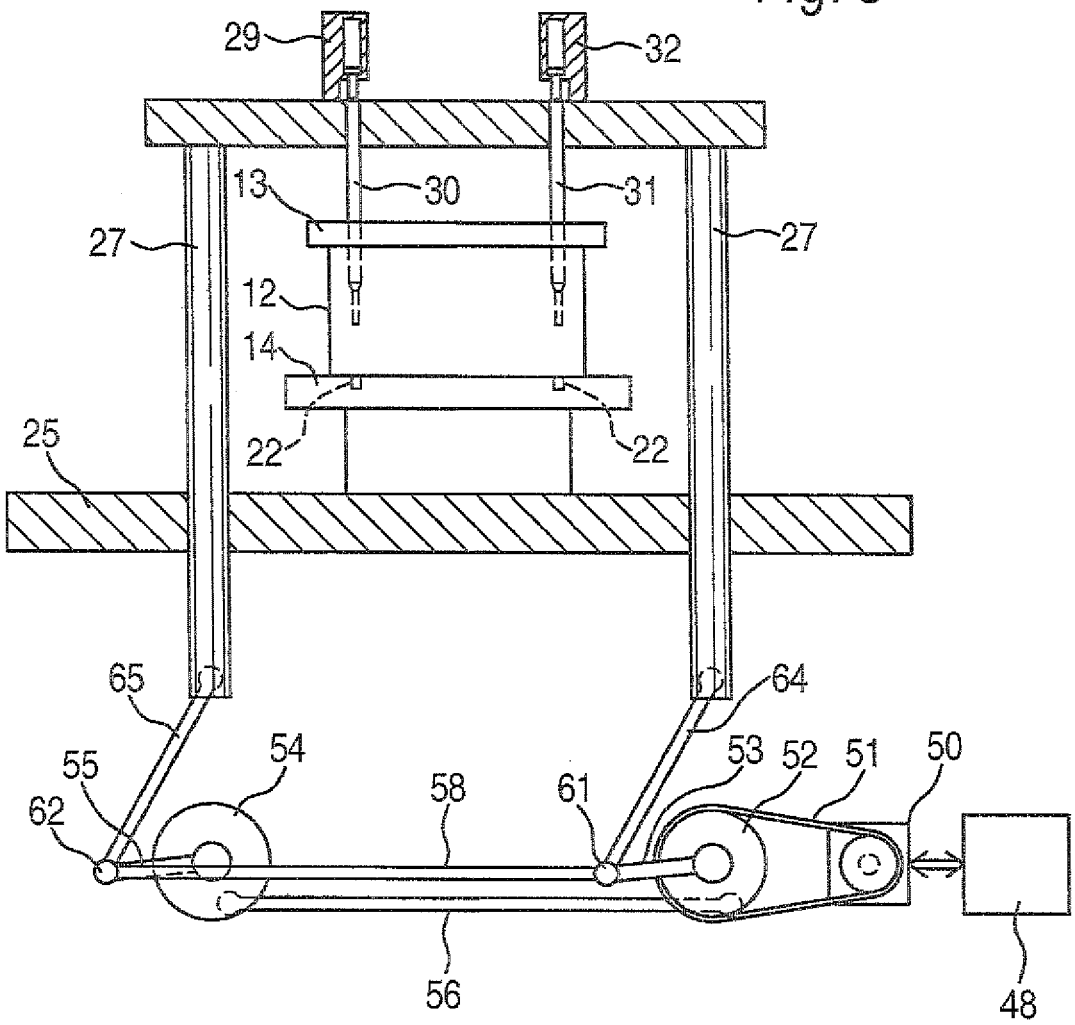
FIG. 3 shows the device in the upper working position.
Figure 4:
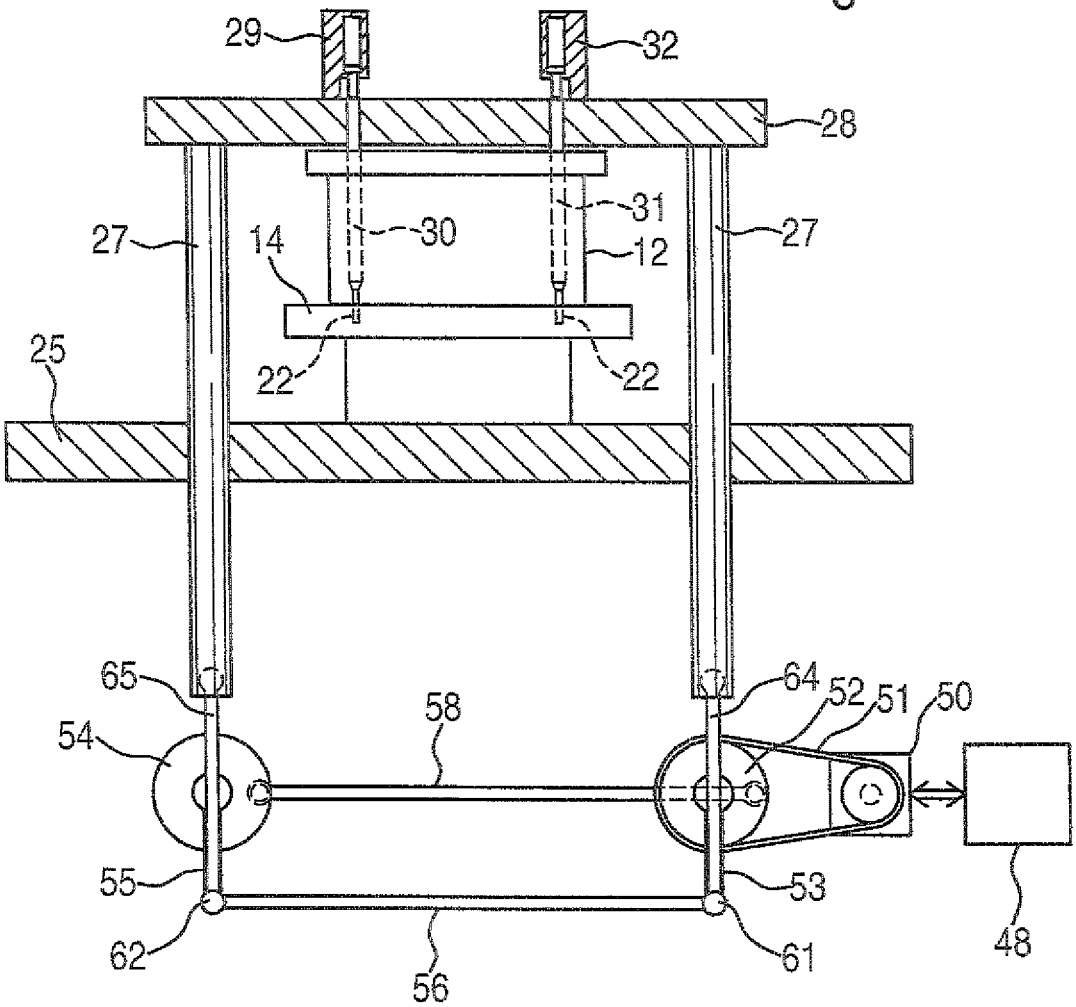
FIG. 4 shows the device in the lower working position.

The drive of the columns 27 and of the rams 30, 31 connected via the support 28 are essential to the invention. In FIGS. 2 through 4, examples are shown of how two columns 27 are moved synchronously up and down. However, more than two columns 27, for instance as three of four of them, may be driven synchronously in the same way. A servo drive 50, as an example for a drive means, is triggered by a controller 48. The servo drive 50 is connected, via a belt 51, to a first gear mechanism 52, namely a first crank drive 52. At the center point of the axis of rotation of the first crank drive 52, a first crank 53 is connected to the first crank drive 52. The motion of the first crank drive 52 is transmitted, via the first crank 53 and a first crank joint 61, to a first coupling rod 64, which is connected to the column 27 via a joint. In an identical way, a second gear mechanism 54 is also provided, which is embodied as a second crank drive 54. Once again, at the center point of the axis of rotation of the second crank drive 54, a second crank 55 is second to the second crank drive 54, whose motion is transmitted onward, via a second crank joint 62 and a second coupling rod 65, to the second column 27, again via a joint not identified by reference numeral. To assure the synchronicity of the motion of the two gear mechanisms 52, 54, a first connection means 56 is provided on the outer circumference of the first crank drive 52 and of the second crank drive 54, and this element assures that the motion of the first crank drive 52 is transmitted to the second crank drive 54. Also, the two cranks 53, 55 are connected via a second connection means 58 at the two crank joints 61, 62. As a result, greater stability of the arrangement can be assured. Moreover, the synchronicity of the courses of motion of the first and second coupling rods 64, 65 is improved. The two crank drives 52, 54 are each embodied as disks. As the connection means 56, 58, coupling rods can for instance be used.

For forming the compacts in the bores 22 from the powder located in the container 11 for material to be dispensed, the dosing disk 14 is rotated incrementally clockwise or counterclockwise to beneath the respective rams 30 of the ram support 29. Next, upon a downward motion of the support 28, the rams 30 penetrate the dosing chambers 22 of the dosing disk 14, whereupon the powder located in the bore 22 is compressed. During the compression or compacting of the powder, the intermediate ring 26 forms a counterpart bearing for the rams 30 and powder. Next, the rams 30 are moved out of the dosing chambers 22 of the dosing disk 14 again by means of the support 28, whereupon the dosing disk 14 is rotated into the vicinity of the next ram support 29. After the last compacting operation, the compacts thus formed reach the vicinity of the expulsion rams 31, where they are inserted into the lower capsule parts 3 that have been furnished by the segments 17. Next, the lower capsule parts 3 are joined to the upper capsule parts 2 again.

The rams 30, 31 mounted on the support 28 are displaced upward and downward via four synchronously moved columns 27. This kind of normal operating mode is shown in FIGS. 3 and 4. In FIG. 3, the rams 30, 31 are in the upper position. To that end, the controller 48 triggers the servo drive 50, beginning at the position shown in FIG. 4, in such a way that the first crank drive 52 and with it the first crank 53 are located in the position shown in FIG. 3. What is essential here is that the second crank drive 54 also synchronously moves the corresponding column 27 with the same stroke as the column 27 that is moved by the first crank drive 52. In order to reach the lower stuffing position, as shown in FIG. 4, the servo drive 50 is now triggered to produce a counterclockwise rotation until such time as the first crank 53 is located in the position shown in FIG. 4. In the associated angular position, a reversal of the direction of rotation is in turn performed; the crank drives 52, 54 are now moved clockwise again into the position shown in FIG. 3. In the position shown in FIG. 3, a reversal of the direction of rotation is effected once again, and the crank drives 52, 54 are moved counterclockwise again into the position shown in FIG. 4, and so forth.

In the controller 48, different motion profiles can be stored in memory. On the one hand, the desired stroke can be varied quite easily. To do so, the corresponding angles at which the reversal of the direction of motion is to be done in accordance with FIGS. 3 and 4 are changed. On the other hand, however, it can be assured by means of the geometry selected that the lower position of the rams 30, 31 is not further undershot, since the cranks 53, 55 already assume a position such that further movement downward is no longer allowed. In principle, however, it would also be conceivable not to shift the reversal point in FIG. 4 into the extreme position of the cranks 53, 55, so that in principle, further motion downward would be possible for adaptation to different dosing disk geometries. Moreover, via the controller 48, a maintenance mode can be activated. In it, the specification of angles for the servo drive 50 is selected such that the maximum stroke of the rams 30, 31 upward is attained, for instance for the sake of the easiest possible access for cleaning purposes to the casing 12, cap 13, and dosing disk 14. This position is shown in FIG. 2.

Moreover, various acceleration profiles can be stored in memory in the controller 48. Thus the ram forces can be varied in a targeted way. A rapid approach to the stuffing position, associated with high acceleration, assures high stuffing ram forces. A low-speed approach to the position shown in FIG. 4, at low acceleration, assures low stuffing forces. The higher the stuffing forces, the greater the density and weight of the powder in the dosing chamber 22.

As the gear mechanisms 52, 54, any arbitrary gear mechanism can be considered; in the exemplary embodiment of FIGS. 2 through 4, it is a crank drive. However, what is essential is that the rotary motions of the servo drive 50 are converted into a defined stroke of the columns 27 by the corresponding gear mechanism 52, 54, and the gear mechanisms 52, 54 are operated synchronously. Besides the coupling rods 58, 56 described, know types of coupling can be considered as the coupling mechanism, such as belts, gear wheels, chains, and so forth. However, the motion profile is predetermined centrally by means of only a single servo drive 50.

The foregoing relates to the preferred exemplary embodiments of the invention, it being understood that other variants and embodiments thereof are possible within the spirit and scope of the invention, the latter being defined by the appended claims.

The invention claimed is:

1. A device for filling at least one dosing chamber, comprising:

at least one dosing chamber disposed in a dosing disk, into which chamber a material to be filled is to be placed;

a container storing the material to be filled, the container being disposed above the dosing chamber;

at least one ram, which acts on the material located in the dosing chamber;

at least one support, on which the at least one ram is disposed;

at least two columns connected to the support;

a drive means for moving the at least two columns synchronously up and down; and a coupling mechanism connecting said drive means and the at least the two columns, wherein, in the normal mode of operation, the drive means puts the support into a first stroke position, and based on this first stroke position, after a reversal of the direction of rotation of the drive means, the support is put into a second stroke position, wherein both the first stroke position and the second stroke position are normal operating positions and wherein the drive means can put the support into a third stroke position for raising the support above the container and the normal operating positions and into a maintenance position whereby the at least one ram is pulled completely out of the container.

2. The device as defined by claim 1, wherein the drive means predetermines a motion profile of the columns.

3. The device as defined by claim 1, wherein the drive means is centrally programmable.

4. The device as defined by claim 1, wherein the coupling mechanism includes at least one gear mechanism.

5. The device as defined by claim 3, wherein the coupling mechanism includes at least one gear mechanism.

6. The device as defined by claim 4, wherein the at least one gear mechanism is a crank drive.

7. The device as defined by claim 5, wherein the at least one gear mechanism is a crank drive.

8. The device as defined by claim 1, wherein at least two gear mechanisms of the coupling mechanism are connected to one another by at least one connection means.

9. The device as defined by claim 2, wherein at least two gear mechanisms of the coupling mechanism are connected to one another by at least one connection means.

10. The device as defined by claim 3, wherein at least two gear mechanisms of the coupling mechanism are connected to one another by at least one connection means.

11. The device as defined by claim 1, wherein the drive means is embodied as a servo drive.

12. The device as defined by claim 4, wherein the drive means is connected to the at least one gear mechanism via a belt.

13. The device as defined by claim 6, wherein the crank drive includes at least one crank, which is connected to at least one of the columns via at least one coupling rod.

14. The device as defined by claim 1, further comprising a controller for triggering the drive means, which triggers the drive means in a normal mode of operation, in which via the coupling mechanism and columns, the support executes a defined stroke.

15. The device as defined by claim 14, wherein the controller triggers the drive means with a predeterminable acceleration.

16. The device as defined by claim 14, wherein that in the maintenance mode, the controller triggers the drive means such that the support is put, with a defined stroke, into the maintenance position.

17. The device as defined by claim 1, wherein the coupling mechanism includes a crank drive.

* * * * *